United States Patent [19]

Vera

[11] Patent Number: 4,625,631

[45] Date of Patent: Dec. 2, 1986

[54] METHOD AND APPARATUS FOR EXTENDING VENTILATION DUCTWORK

[75] Inventor: Samuel I. Vera, Golden, Colo.

[73] Assignee: Mobil Oil Corporation, New York, N.Y.

[21] Appl. No.: 691,966

[22] Filed: Jan. 16, 1985

[51] Int. Cl.[4] ..... E21F 17/02

[52] U.S. Cl. ..... 98/50; 98/DIG. 7; 74/89.22; 104/182; 138/107; 248/61; 254/407

[58] Field of Search ..... 98/50, DIG. 7; 138/107; 104/115, 116, 182; 74/89.22; 248/61, 558; 254/407

[56] References Cited

U.S. PATENT DOCUMENTS

| | | | |
|---|---|---|---|
| 627,563 | 6/1899 | Wright | 254/407 X |
| 952,539 | 3/1910 | Lugo-Viña | 104/115 X |
| 1,043,604 | 11/1912 | Kalmanovits | 254/407 X |
| 2,182,602 | 12/1939 | Veteran | 254/407 X |

FOREIGN PATENT DOCUMENTS

| | | | |
|---|---|---|---|
| 66000 | 12/1982 | European Pat. Off. | 98/50 |
| 2429058 | 1/1976 | Fed. Rep. of Germany | 98/50 |
| 2433034 | 1/1976 | Fed. Rep. of Germany | 98/50 |
| 239474 | 10/1945 | Switzerland | 104/115 |
| 427886 | 7/1967 | Switzerland | 104/182 |
| 983281 | 12/1982 | U.S.S.R. | 98/50 |

*Primary Examiner*—Harold Joyce

*Attorney, Agent, or Firm*—Alexander J. McKillop; Michael G. Gilman; Charles J. Speciale

[57] ABSTRACT

An apparatus and method for advancing extendable ventilation ductwork in an underground facility is disclosed wherein a mechanical cable and pulley system is utilized in conjunction with a support swivel. The support swivel permits support clips to advance without interference from support members. The cable and pulley system comprises a cable, support swivel, head pulley and winding mechanism.

15 Claims, 10 Drawing Figures

METHOD AND APPARATUS FOR EXTENDING VENTILATION DUCTWORK

BACKGROUND OF THE INVENTION

A critical problem in underground mining operations has always been the problem of circulating fresh air to a mining location and exhausting polluted and dust-ridden air. In present operations, air is conveyed to and exhausted from a mining location by temporary ductwork. In general, mining operations must be discontinued temporarily while the ventilation system is advanced.

As mining operations proceed, the excavation location advances. As a result, the intake for fresh air becomes more and more distant from the excavation site. At times, the ventilation ductwork must be advanced by adding additional sections onto the existing ductwork. In order for ductwork sections to be added safely and without interference, mining operations are stopped temporarily while ventilation ductwork is put in place. Normally, this procedure involves moving in large segments of metal ductwork, bolting them in place and placing some form of gasket around the joint to assure a certain degree of air tightness.

SUMMARY OF THE INVENTION

The present invention provides a method and apparatus for deploying and retrieving ventilation ductwork in an underground mining operation. An expandable conduit is attached to a continuous cable between an excavation site and a fresh air intake site. A pulley is located at the excavation site and a winch is located at the intake site. A series of hangers are located between the excavation and exhaust sites. Each hanger has two sections, a pulley section and a swivel section. The pulley section is located on the upper part of the hanger and provides a support and a guide for the top portion continuous cable. The swivel section provides support for the bottom portion of the continuous cable while permitting clips attached to an expandable ventilation ductwork to pass by the support without interfering with continuous cable movement.

DESCRIPTION OF THE PREFERRED EMBODIMENT

Figure 1:
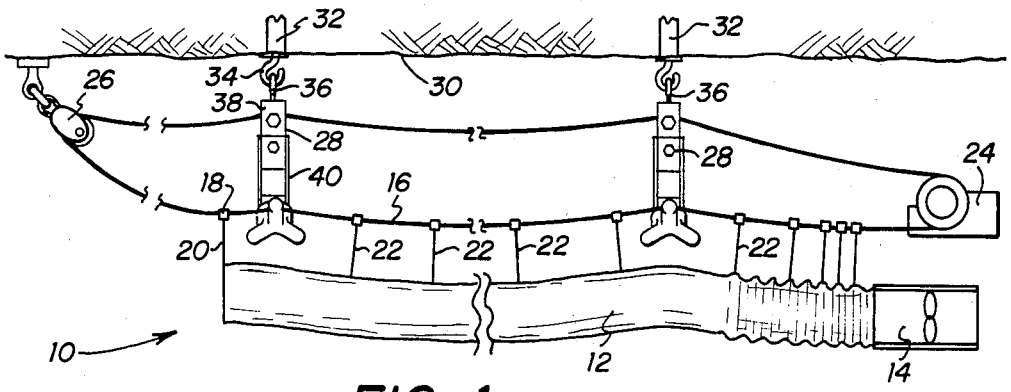
FIG. 1 is a side view of an expandable ventilation ductwork system.

FIG. 1 illustrates an expandable ventilation ductwork system 10 having ventilation ductwork 12 connected to a fan housing 14 at an intake site at one end and to a continuous cable 16 by friction clamp 18 through connecting wire 20 at the other end. Ductwork 12 is slidably connected to continuous cable 16 through clips 22 spaced apart and fixed along ductwork 12.

Continuous cable 16 extends from winch 24 to pulley 26 running through hangers 28 in a manner that an extended elipse is formed when viewed from the side. Hanger 28 is hung from a mine ceiling 30 by anchors 32 having eye bolts 34 for receiving loops 36 of hangers 28. Hangers 28 have two sections, a support section 38 and a swivel section 40.

Figure 2:
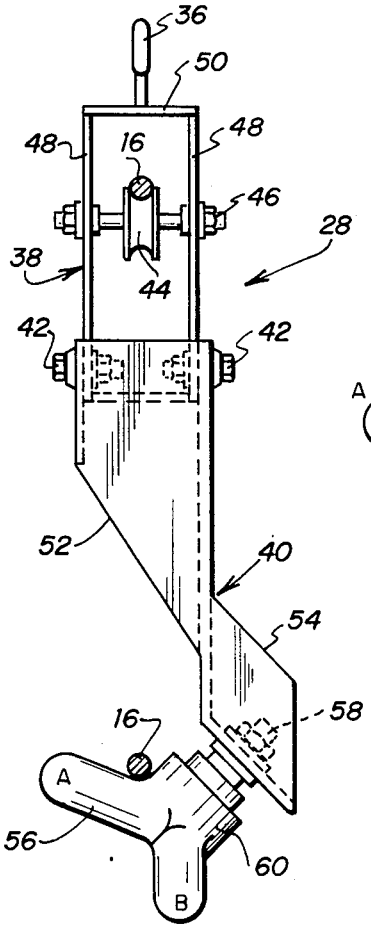
FIG. 2 is a side view of a hanger of FIG. 1.

Referring to FIG. 2, a side view of hanger assembly 28 is illustrated with support section 38 bolted to swivel section 40 by bolts 42. Continuous cable 16 is illustrated as riding on return pulley 44 which rotates on axle 46, which is mounted between walls 48 fixed to top 50. Loop 36 is attached to top 50 so that hanger assembly 28 may be placed on eye bolt 34 of anchor 32 (see FIG. 1).

Swivel section 40 comprises a housing section 52 bolted to housing sides 48 with bolts 42. Housing 52 has an offset 54 for mounting swivel 56 on axis 58.

Figure 3:
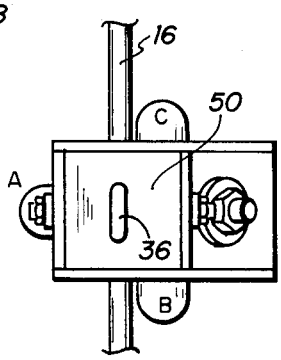
FIG. 3 is a top view of the hanger of FIG. 2.
Figure 4:
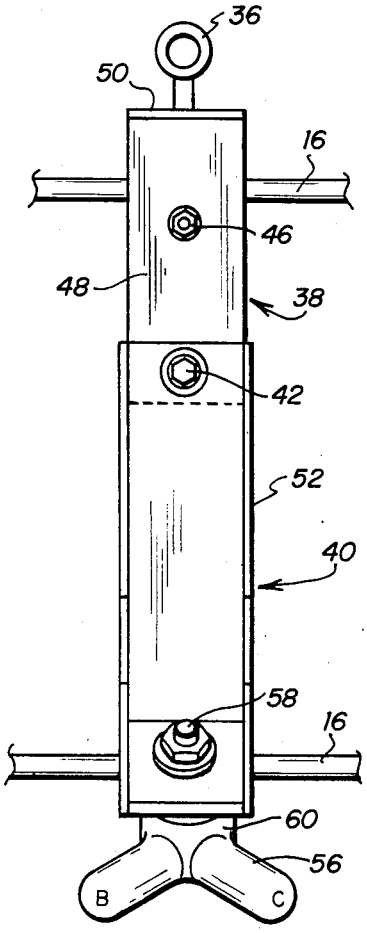
FIG. 4 is a rear view of the hanger of FIG. 2.

FIG. 3 illustrates a top view of the apparatus of FIG. 2 illustrating stubs A, B and C of swivel 56. FIG. 4 illustrates a rear view of the apparatus of FIG. 2, more clearly illustrating housing 52 having swivel 56 mounted thereto. As illustrated, continuous cable 16 runs across pulley 44 mounted on axle 46 traveling in one direction while traveling across swivel 56 in the opposite direction.

Figure 5:
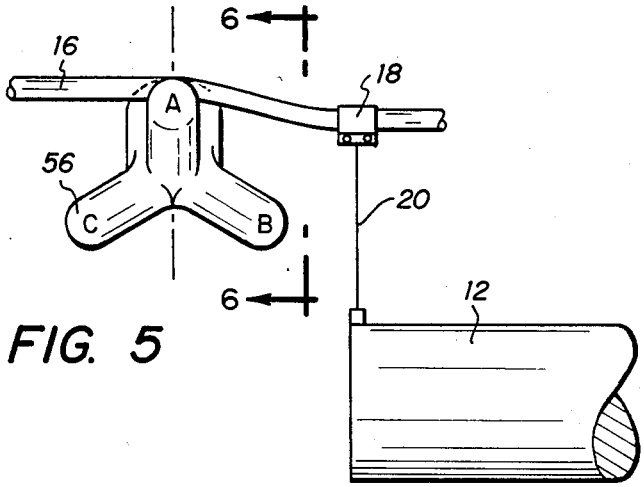
FIG. 5 is a front view of a swivel portion of a hanger of FIG. 1.
Figure 6:
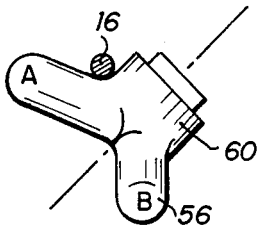
FIG. 6 is a sectional view along line 6—6 of FIG. 5.

The operation of swivel 56 mounted on offset 54 of housing 52 is best illustrated in conjunction with FIGS. 5–10. FIG. 5 illustrates swivel 56 with continuous cable 16 riding behind stub A. As friction clamp 18 connected to ventillation duct 12 through connecting wire 20 approaches swivel 56, stubs A, B and C remain motionless. Continuous cable 16 is sliding on the corner of stub A and the body 60 of swivel 56. Body 60 of swivel 56 is configured to contain gearing torque release to hold stub A in position while continuous cable 16 slides thereon. Continuous cable 16 may either be a wire cable or any type of rope currently in use in the art. Furthermore, continuous cable 16 may be greased to permit easier sliding on swivel 56.

Figure 7:
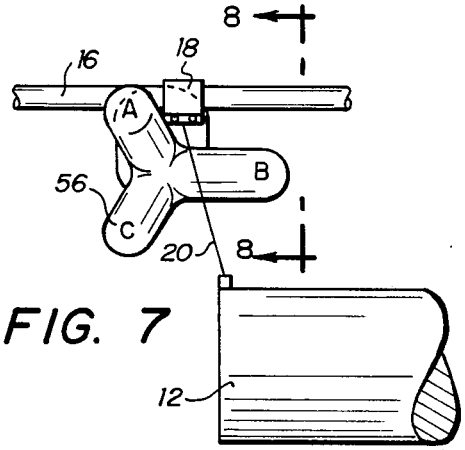
FIG. 7 is a front view of the swivel of FIG. 2 in a second position.
Figure 8:
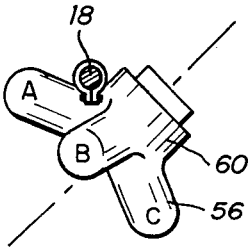
FIG. 8 is a sectional view along lines 8—8 of FIG. 7.

Referring to FIG. 7, friction clamp 18 along with connecting wire 20 come into contact with stub A of swivel 56. Friction clamp 18 on continuous cable 16 causes torque release of swivel 56 allowing stub A to rotate with stub B picking up continuous cable 16 behind friction clamp 18. Friction clamp 18 does not ride off swivel 56 because of the weight of duct 12 which pulls down via connecting wire 20. Swivel 56 is configured at an angle with horizontal such that connecting wire 20 passes between stub A and stub B while continuous cable 16 rides on the corner formed by stub A and stub B with body 60 of swivel 56. Stubs A, B and C are fixed with respect to each other so that all three rotate in unison. Preferably, stubs A, B and C are configured at 120° apart from each other when viewed facing their axis of rotation. Although three stubs are used for swivel 56, other numbers of stubs may be used as long as swivel 56 remains balanced and there is sufficient room for friction clamp 18 to engage only one stub at a time.

Figure 9:
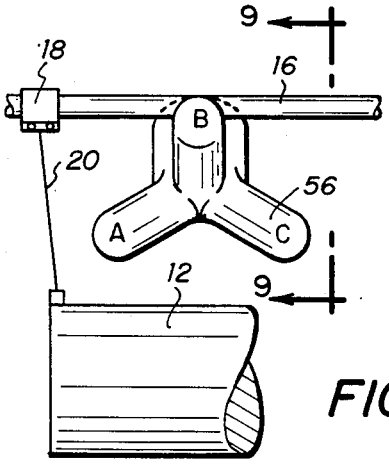
FIG. 9 is a front view of the swivel of FIG. 2 in a third position.
Figure 10:
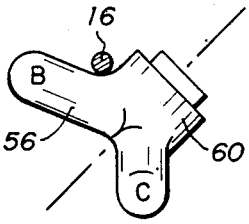
FIG. 10 is a sectional view along lines 10—10 of FIG. 9.

Referring to FIG. 9, continuous cable 16 has advanced sufficiently so that friction clamp 18 and connecting wire 20 have advanced ductwork 12 past swivel unit 56. As illustrated in FIG. 10, continuous cable 16 is riding on the corner between body 60 and stub B of swivel 56. Continuous cable 16 will slide on this position until ventilation ductwork 12 is advanced to the point where clip 22 engages stub B causing torque release of swivel 56, allowing stub B to rotate and bring stub C into position for additional contact with a second clip 22.

For return of extendable duct, the torque release of swivel 56 is preset lower in the reverse rotation mode, allowing duct 12 to return near fan housing 14. Referring to FIG. 1, ventilation ductwork system 10 advance is accomplished by advancing pulley 26 and adding hanger assemblies 28 as needed to support duct 12.

While the preferred embodiment has been described by way of preferred embodiment, it is to be understood that this is for illustration purposes only and should not be limited thereto, but only by the scope of the following claims.

I claim:

1. An extendable ventilation ductwork system comprising:

an extendable ventilation ductwork adapted to connected at one end to a fresh air source;

a pulley fixed at the point of furthest desired extension of said extendable ductwork;

deployment means for paying out and taking in a cable fixed at the point of deployment of said extendable ductwork;

a cable extending between said pulley and said deployment means to thereby form a lower deployment line and an upper return line;

securing means for fixedly connecting the other end of said extendable ductwork to said lower line;

a clip means slidably mounted on said lower line between said securing means and said deployment means;

support means for connecting said clip means to a point on said extendable ductwork between said ends thereof whereby said support means will pull said clip means along said lower line when said deployment means is actuated to extend said ductwork to provide support for said ductwork from said lower line;

a hanger assembly affixed over said cable at a point between said pulley and said deployment means, said hanger assembly comprising:

a housing;

a swivel having a body and a plurality of stubs radially spaced around said body at equal angles to each other, each of said stubs extending outwardly from the body at an angle with respect to the centerline of said body;

pivot means for rotatably mounting said swivel on said housing, said pivot means passing through the centerline of said body whereby each stub is adapted to receive and support said lower line of said cable when said stub is in its uppermost position on said body until said stub is contacted by said clip means, said swivel being rotated by said clip means as it moves along said lower line to move the next of said stubs into said uppermost position to support said lower line while permitting said clip means to pass through said swivel.

2. The extendable ventilation ductwork system of claim 1 wherein said hanger assembly further includes;

a support section having a pulley mounted therein to support said return line of said cable; and means for connecting said housing to said support section.

3. The extendable ventilation ductwork system of claim 1 wherein said deployment means comprises:

a winch.

4. The extendable ventilation ductwork system of claim 1 including:

a plurality of clip means slidable positioned on said lower line of said cable; and a respective support for connecting each of said plurality of clip means to a corresponding point on said extendable ductwork.

5. The extendable ventilation ductwork system of claim 4 wherein said support means is comprised of flexible wire.

6. The extendable ventilation ductwork system of claim 2 including:

a plurality of said hanger assemblies fixed at spaced intervals between said pulley and said deployment means.

7. The extendable ventilation ductwork system of claim 1 wherein said pluraltiy of stubs comprise:

three stubs radially positioned at 120° angles on said body.

8. An extendable ventilation ductwork system for deployment in a substantially horizontal mineshaft, said system comprising:

an extendable ventilation ductwork adapted to be connected at one end to a fresh air source and adapted to extend substantially parallel below the roof of a horizontal mineshaft;

a pulley;

means for affixing said pulley from said roof of said mineshaft at the point furthest desired extension of said extendable ductwork;

deployment means for paying out and taking in a cable, said deployment means fixed at the point of deployment of said extendable ductwork;

a cable positioned between said roof of said mineshaft and said extendable ductwork and extending between said pulley and said deployment means to thereby form a lower deployment line and an upper return line;

securing means for fixedly connecting the other end of said extendable ductwork to said lower line of said cable;

a clip means slidably mounted on said lower line between said securing means and said deployment means;

support means for connecting said clip means to a point on said extendable ductwork between said ends thereof whereby said support means will pull said clip means along said lower line when said deployment means is actuated to extend said ductwork so that said support means will support said ductwork from said lower line;

a hanger assembly comprising:

a housing;

a swivel having a body and a plurality of stubs radially spaced around said body at equal angles to each other, each of said stubs extending outwardly from the body at an angle with respect to the centerline of said body, pivot means for rotatably mounting said swivel on said housing, said pivot means passing through the centerline of said body whereby a particular stub is adapted to receive and support said lower line of said cable when said particular stub is in its uppermost position on said body until said stub is contacted by said clip means and said swivel is rotated by said clip means as it moves along said lower line to move the next of said stubs into position to support said lower line while permitting said clip means to pass through said swivel; and means for affixing said hanger assembly from said roof of said mineshaft at a point between said pulley and said deployment means.

9. The extendable ventilation ductwork system of claim 8 wherein said hanger assembly further includes:

a support section having a pulley mounted therein to support said return line of said cable; and means for connecting said housing to said support section.

10. The extendable ventilation ductwork system of claim 9 wherein said means for affixing said hanger assembly comprises:

an anchor hook in said roof; and an eye on said support section of said hanger assembly.

11. The exxtendable ventilation ductwork system of claim 10 wherein said deployment means comprises:

a winch.

12. The extendable ventilation ductwork system of claim 11 including:

a plurality of clip means slidably positioned on said lower line of said cable; and a respective support for connecting each of said plurality of clip means to a corresponding point on said extendable ductwork.

13. The extendable ventilation ductwork system of claim 12 wherein said support means is comprised of flexible wire.

14. The extendable ventilation ductwork system of claim 13 including:

a plurality of said hanger assemblies fixed at spaced intervals between said pulley and said deployment means.

15. The extendable ventilation ductwork system of claim 14 wherein said plurality of studs comprise:

three stubs radially positioned at 120° angles on said body.

* * * * *